US011539133B2

(12) United States Patent
Chang et al.

(10) Patent No.: US 11,539,133 B2
(45) Date of Patent: Dec. 27, 2022

(54) ANTENNA STRUCTURE

(71) Applicant: Acer Incorporated, New Taipei (TW)

(72) Inventors: Kun-Sheng Chang, New Taipei (TW); Ching-Chi Lin, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 17/367,495

(22) Filed: Jul. 5, 2021

(65) Prior Publication Data

US 2022/0336948 A1 Oct. 20, 2022

(30) Foreign Application Priority Data

Apr. 19, 2021 (TW) ..... 110113907

(51) Int. Cl.

| | |
|---|---|
| ***H01Q 1/24*** | (2006.01) |
| ***H01Q 5/314*** | (2015.01) |
| ***H01Q 9/26*** | (2006.01) |
| ***H01Q 5/42*** | (2015.01) |

(52) U.S. Cl.

CPC ..... *H01Q 5/314* (2015.01); *H01Q 5/42* (2015.01); *H01Q 9/26* (2013.01)

(58) Field of Classification Search

CPC .. H01Q 1/24; H01Q 1/38; H01Q 5/31; H01Q 5/314; H01Q 1/48; H01Q 5/42; H01Q 9/26

See application file for complete search history.

(56) References Cited

U.S. PATENT DOCUMENTS 7,403,165 B2 * 7/2008 Qi ..... H01Q 1/243 343/702
7,903,035 B2 * 3/2011 Mikkola ..... H01Q 1/36 343/702

(Continued)

FOREIGN PATENT DOCUMENTS

TW 201511406 A 3/2015
TW I672863 B 9/2019

OTHER PUBLICATIONS

Chinese language office action dated Sep. 29, 2021, issued in application No. TW 110113907.

*Primary Examiner* — Tho G Phan
(74) *Attorney, Agent, or Firm* — McClure, Qualey & Rodack, LLP

(57) ABSTRACT

An antenna structure includes a first radiation element, a second radiation element, a third radiation element, a fourth radiation element, and a dielectric substrate. The first radiation element is coupled to a ground voltage. The first radiation element includes a variable-width portion. The second radiation element has a feeding point. The second radiation element is adjacent to the first radiation element. The third radiation element is coupled to the variable-width portion of the first radiation element. The fourth radiation element is coupled to the second radiation element. The dielectric substrate has a first surface and a second surface which are opposite to each other. The second radiation element and the fourth radiation element are disposed on the first surface of the dielectric substrate. The first radiation element and the third radiation element are disposed on the second surface of the dielectric substrate.

13 Claims, 7 Drawing Sheets

(56) References Cited

U.S. PATENT DOCUMENTS

| | | | | |
|---|---|---|---|---|
| 2012/0299779 | A1* | 11/2012 | Yen | H01Q 1/243 343/700 MS |
| 2014/0028511 | A1* | 1/2014 | Rao | H01Q 5/35 343/729 |
| 2015/0061952 | A1 | 3/2015 | Chiang et al. | |
| 2015/0097733 | A1* | 4/2015 | Wei | H01Q 1/243 343/700 MS |
| 2020/0243962 | A1* | 7/2020 | Lo | H01Q 5/10 |

* cited by examiner

ANTENNA STRUCTURE

CROSS REFERENCE TO RELATED APPLICATIONS

This application claims priority of Taiwan Patent Application No. 110113907 filed on Apr. 19, 2021, the entirety of which is incorporated by reference herein.

BACKGROUND OF THE INVENTION

Field of the Invention

The disclosure generally relates to an antenna structure, and more particularly, it relates to a wideband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has insufficient bandwidth, it will negatively affect the communication quality of the mobile device. Accordingly, it has become a critical challenge for antenna designers to design a wideband antenna element with a small size.

BRIEF SUMMARY OF THE INVENTION

In an exemplary embodiment, the disclosure is directed to an antenna structure that includes a first radiation element, a second radiation element, a third radiation element, a fourth radiation element, and a dielectric substrate. The first radiation element is coupled to a ground voltage. The first radiation element includes a variable-width portion. The second radiation element has a feeding point. The second radiation element is adjacent to the first radiation element. The third radiation element is coupled to the variable-width portion of the first radiation element. The fourth radiation element is coupled to the second radiation element. The dielectric substrate has a first surface and a second surface which are opposite to each other. The second radiation element and the fourth radiation element are disposed on the first surface of the dielectric substrate. The first radiation element and the third radiation element are disposed on the second surface of the dielectric substrate.

In some embodiments, the variable-width portion of the first radiation element substantially has a trapezoidal shape.

In some embodiments, the second radiation element substantially has a meandering shape.

In some embodiments, the third radiation element substantially has an L-shape.

In some embodiments, the fourth radiation element substantially has a straight-line shape.

In some embodiments, the antenna structure further includes a fifth radiation element. The fifth radiation element is coupled to the feeding point, and is disposed on the first surface of the dielectric substrate. The fifth radiation element substantially has an L-shape.

In some embodiments, the fifth radiation element has a vertical projection on the second surface of the dielectric substrate, and the vertical projection at least partially overlaps the variable-width portion of the first radiation element.

In some embodiments, the antenna structure further includes a sixth radiation element. The sixth radiation element is coupled to the ground voltage, and is disposed on the first surface of the dielectric substrate. The sixth radiation element substantially has a straight-line shape.

In some embodiments, the antenna structure covers a first frequency band, a second frequency band, a third frequency band, a fourth frequency band, a fifth frequency band, and a sixth frequency band. The first frequency band is from 600 MHz to 700 MHz. The second frequency band is from 700 MHz to 960 MHz. The third frequency band is from 1710 MHz to 2170 MHz. The fourth frequency band is from 2300 MHz to 2700 MHz. The fifth frequency band is from 3300 MHz to 4800 MHz. The sixth frequency band is from 5000 MHz to 6000 MHz.

In some embodiments, the length of the first radiation element is substantially equal to 0.25 wavelength of the first frequency band. The length of the second radiation element is substantially equal to 0.25 wavelength of the second frequency band. The length of the third radiation element is from 0.125 to 0.25 wavelength of the third frequency band. The length of the fourth radiation element is shorter than or equal to 0.125 wavelength of the fourth frequency band. The length of the fifth radiation element is substantially equal to 0.25 wavelength of the fifth frequency band. The length of the sixth radiation element is substantially equal to 0.25 wavelength of the sixth frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
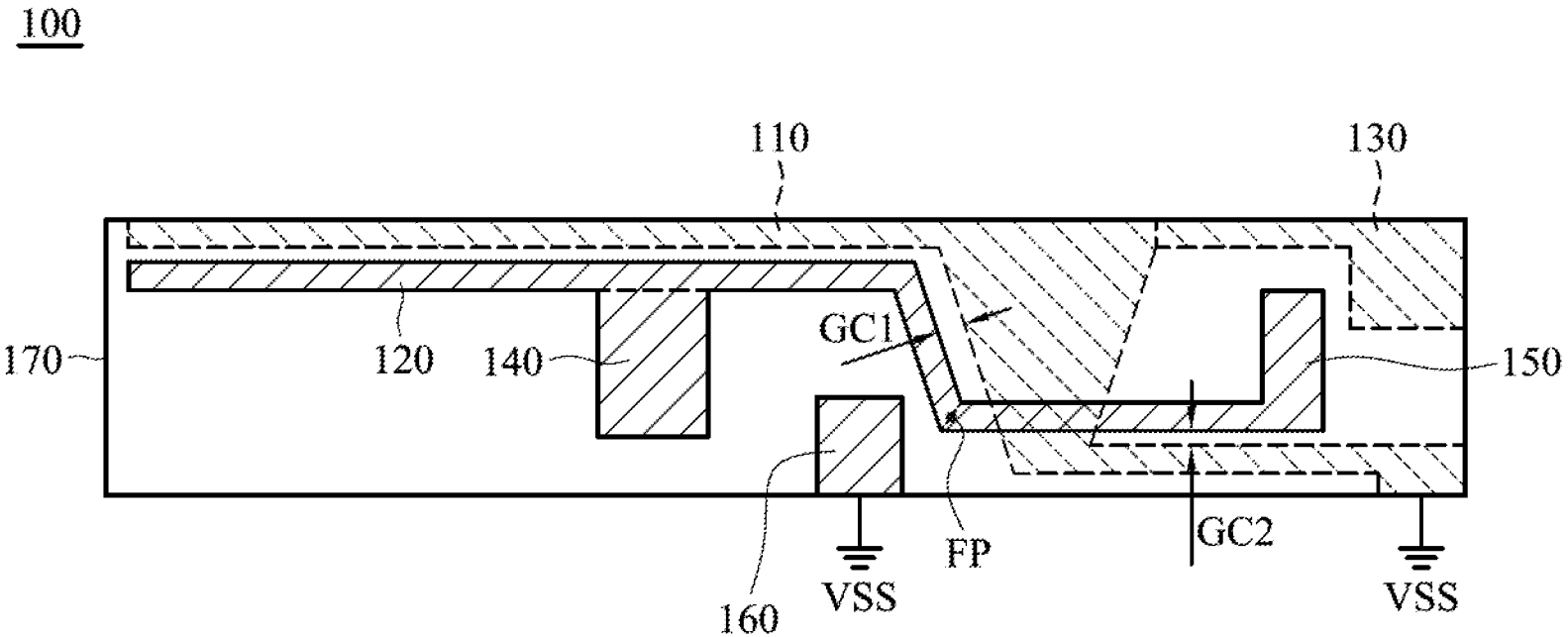
FIG. 1 is a top view of an antenna structure according to an embodiment of the invention.

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

FIG. 1 is a top view of an antenna structure 100 according to an embodiment of the invention. The antenna structure 100 may be applied to a mobile device, such as a smartphone, a tablet computer, or a notebook computer. In the embodiment of FIG. 1, the antenna structure 100 includes a first radiation element 110, a second radiation element 120, a third radiation element 130, a fourth radiation element 140, a fifth radiation element 150, a sixth radiation element 160, and a dielectric substrate 170. The first radiation element 110, the second radiation element 120, the third radiation element 130, the fourth radiation element 140, the fifth radiation element 150, and the sixth radiation element 160 may all be made of metal materials, such as copper, silver, aluminum, iron, or their alloys.

Figure 2:
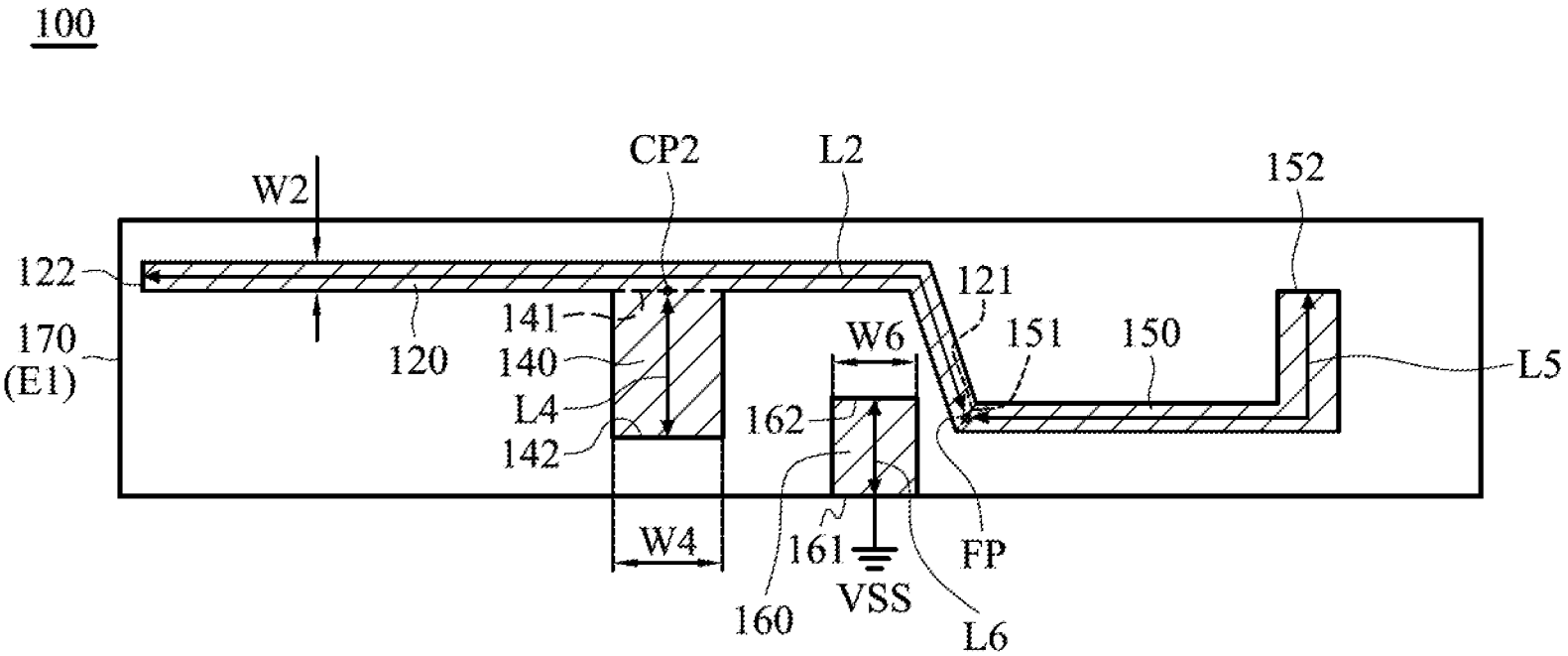
FIG. 2 is a top view of partial elements of an antenna structure on a first surface of a dielectric substrate according to an embodiment of the invention.
Figure 3:
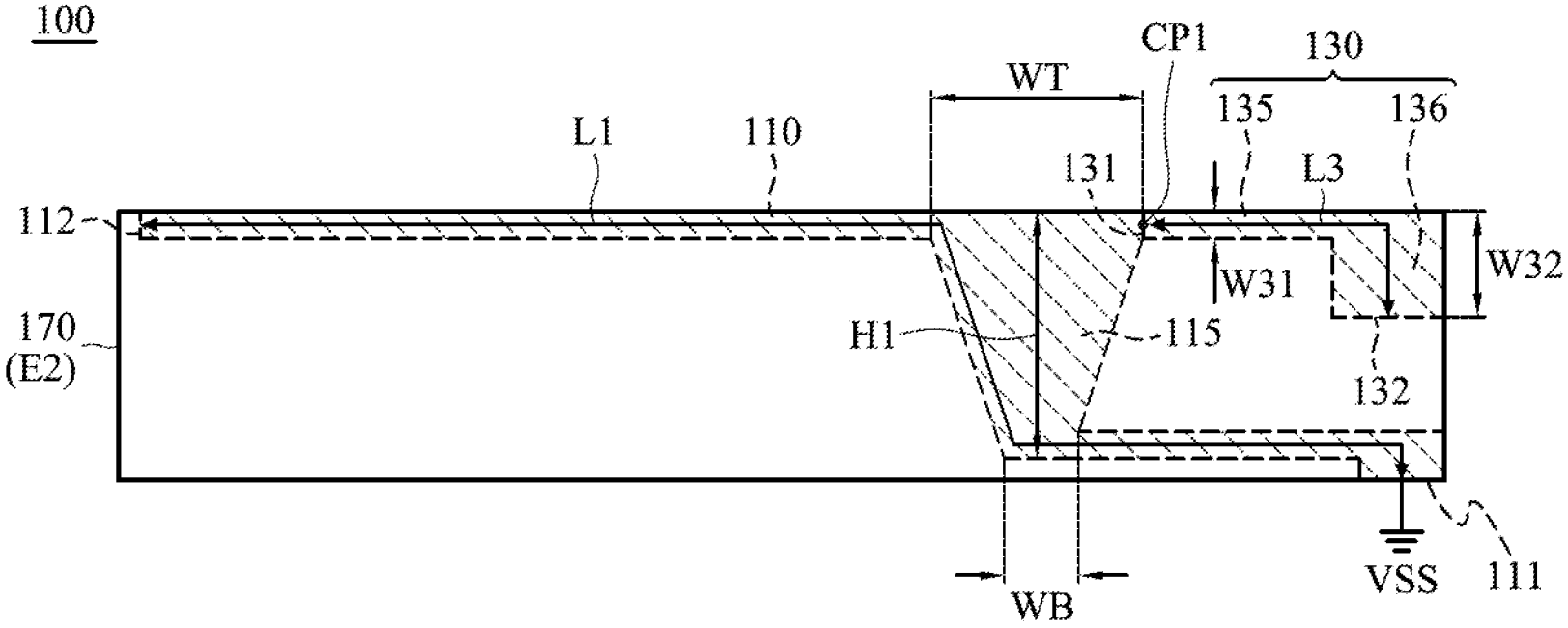
FIG. 3 is a see-through view of other partial elements of an antenna structure on a second surface of a dielectric substrate according to an embodiment of the invention.
Figure 4:
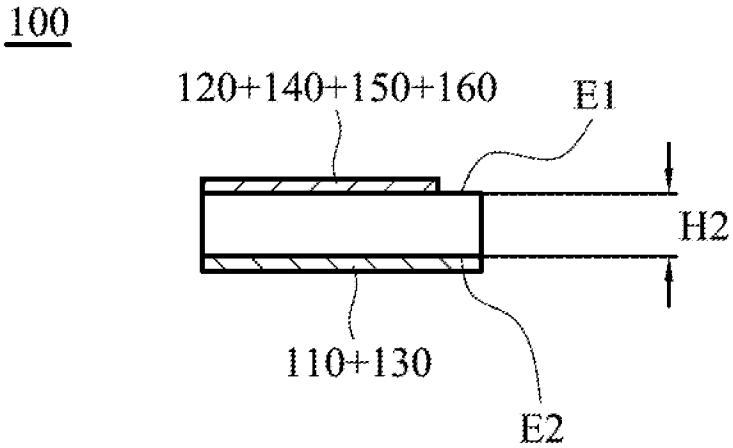
FIG. 4 is a side view of an antenna structure according to an embodiment of the invention.

The dielectric substrate 170 may be an FR4 (Flame Retardant 4) substrate, a PCB (Printed Circuit Board), or an FPC (Flexible Printed Circuit). The dielectric substrate 170 has a first surface E1 and a second surface E2 which are opposite to each other. The second radiation element 120, the fourth radiation element 140, the fifth radiation element 150, and the sixth radiation element 160 are all disposed on the first surface E1 of the dielectric substrate 170. The first radiation element 110 and the third radiation element 130 are both disposed on the second surface E2 of the dielectric substrate 170. FIG. 2 is a top view of partial elements of the antenna structure 100 on the first surface E1 of the dielectric substrate 170 according to an embodiment of the invention. FIG. 3 is a see-through view of other partial elements of the antenna structure 100 on the second surface E2 of the dielectric substrate 170 according to an embodiment of the invention (i.e., the dielectric substrate 170 is considered as a transparent element). FIG. 4 is a side view of the antenna structure 100 according to an embodiment of the invention. Please refer to FIGS. 1-4 together to understand the invention.

The first radiation element 110 may be substantially a variable-width meandering structure. Specifically, the first radiation element 110 has a first end 111 and a second end 112. The first end 111 of the first radiation element 110 is coupled to a ground voltage VSS (e.g., 0V). The second end 112 of the first radiation element 110 is an open end. For example, the ground voltage VSS may be provided by a system ground plane (not shown). It should be noted that the first radiation element 110 includes a variable-width portion 115, which may substantially have a trapezoidal shape. In addition, the top-side width WT of the variable-width portion 115 may be greater than the bottom-side width WB of the variable-width portion 115.

The second radiation element 120 may be substantially an equal-width meandering structure. Specifically, the second radiation element 120 has a first end 121 and a second end 122. A feeding point FP may be positioned at the first end 121 of the second radiation element 120. The second end 122 of the second radiation element 120 may be an open end. The feeding point FP may be further coupled to a signal source (not shown), such as an RF (Radio Frequency) module, for exciting the antenna structure 100. The second radiation element 120 is adjacent to the first radiation element 110. A first coupling gap GC1 is formed between the second radiation element 120 and the first radiation element 110. It should be noted that the term "adjacent" or "close" over the disclosure means that the distance (spacing) between two corresponding elements is smaller than a predetermined distance (e.g., 5 mm or shorter), or means that the two corresponding elements directly touch each other (i.e., the aforementioned distance/spacing therebetween is reduced to 0). In some embodiments, the second radiation element 120 is arranged along at least one portion of the first radiation element 110. For example, the second end 122 of the second radiation element 120 and the second end 112 of the first radiation element 110 may substantially extend in the same direction, and the aforementioned two ends may be also aligned with each other.

The third radiation element 130 may substantially have an L-shape. Specifically, the third radiation element 130 has a first end 131 and a second end 132. The first end 131 of the third radiation element 130 is coupled to a first connection point CP1 on the variable-width portion 115 of the first radiation element 110. The second end 132 of the third radiation element 130 is an open end. In some embodiments, the third radiation element 130 includes a narrow portion 135 and a wide portion 136. The narrow portion 135 is adjacent to the first end 131 of the third radiation element 130. The wide portion 136 is adjacent to the second end 132 of the third radiation element 130.

The fourth radiation element 140 may substantially has a straight-line shape. Specifically, the fourth radiation element 140 has a first end 141 and a second end 142. The first end 141 of the fourth radiation element 140 is coupled to a second connection point CP2 on the second radiation element 120. The second end 142 of the fourth radiation element 140 is an open end. For example, the second end 142 of the fourth radiation element 140 and the second end 132 of the third radiation element 130 may substantially extend in the same direction.

The fifth radiation element 150 may substantially have an L-shape. Specifically, the fifth radiation element 150 has a first end 151 and a second end 152. The first end 151 of the fifth radiation element 150 is coupled to the feeding point FP. The second end 152 of the fifth radiation element 150 is an open end. For example, the second end 152 of the fifth radiation element 150 and the second end 142 of the fourth radiation element 140 may substantially extend in opposite directions. In some embodiments, the fifth radiation element 150 has a vertical projection on the second surface E2 of the dielectric substrate 170, and the vertical projection at least partially overlaps with the variable-width portion 115 of the first radiation element 110. In addition, the fifth radiation element 150 is adjacent to the first radiation element 110. A second coupling gap GC2 is formed between the fifth radiation element 150 and the first radiation element 110. It should be understood that the fifth radiation element 150 is an optional element, which is removable in other embodiments.

The sixth radiation element 160 may substantially have a straight-line shape. Specifically, the sixth radiation element 160 has a first end 161 and a second end 162. The first end 161 of the sixth radiation element 160 is coupled to the ground voltage VSS. The second end 162 of the sixth radiation element 160 is an open end, which is adjacent to the feeding point FP. For example, the second end 162 of the sixth radiation element 160 and the second end 152 of the fifth radiation element 150 may substantially extend in the same direction. It should be understood that the sixth radiation element 160 is another optional element, which is removable in other embodiments.

Figure 5:
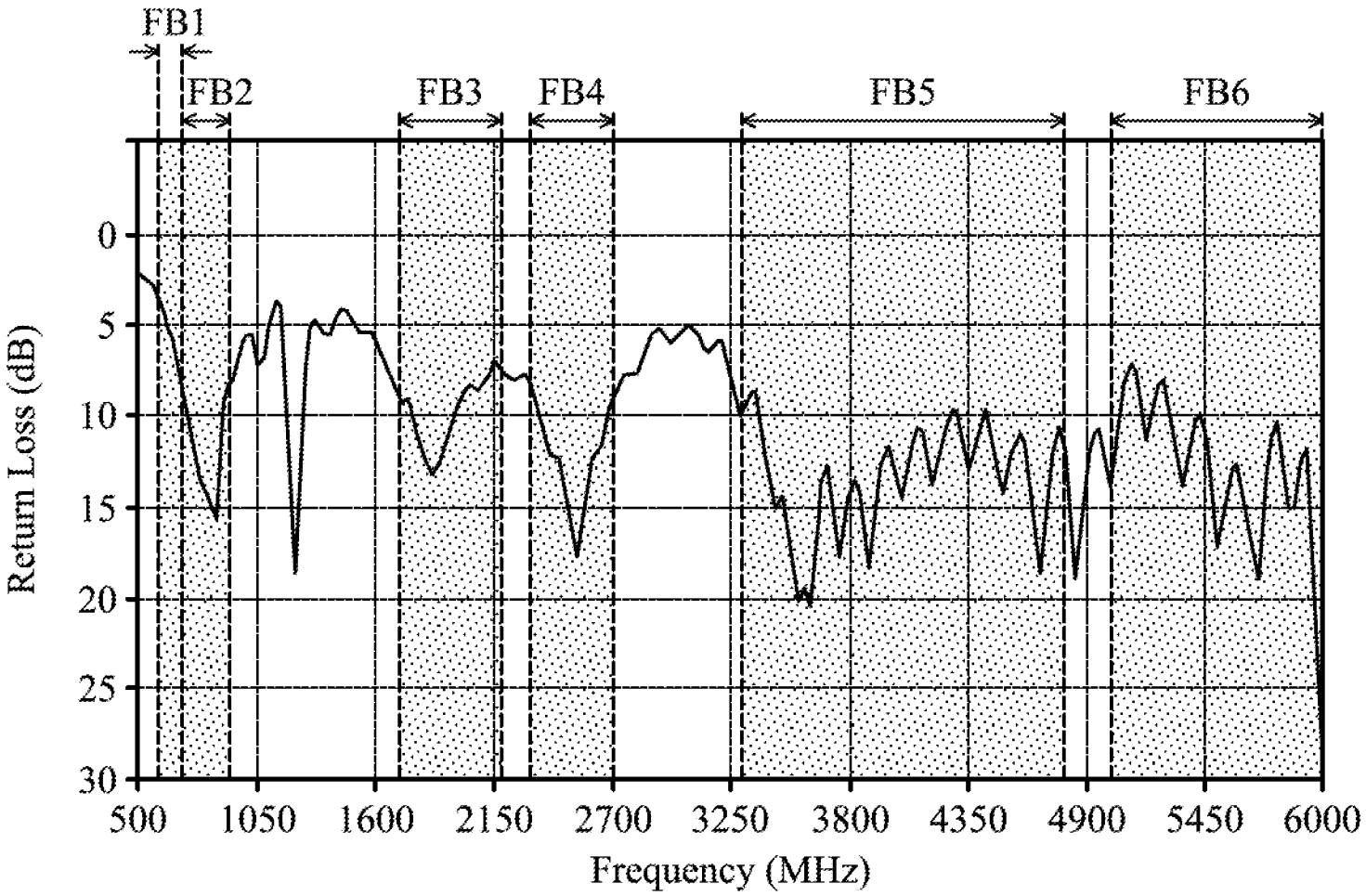
FIG. 5 is a diagram of return loss of an antenna structure according to an embodiment of the invention.

FIG. 5 is a diagram of return loss of the antenna structure 100 according to an embodiment of the invention. The horizontal axis represents the operational frequency (MHz), and the vertical axis represents the return loss (dB). According to the measurement of FIG. 5, the antenna structure 100 can cover a first frequency band FB1, a second frequency band FB2, a third frequency band FB3, a fourth frequency band FB4, a fifth frequency band FB5, and a sixth frequency band FB6. For example, the first frequency band FB1 may be from 600 MHz to 700 MHz. The second frequency band FB2 may be from 700 MHz to 960 MHz. The third frequency band FB3 may be from 1710 MHz to 2170 MHz. The fourth frequency band FB4 may be from 2300 MHz to 2700 MHz. The fifth frequency band FB5 may be from 3300 MHz to 4800 MHz. The sixth frequency band FB6 may be from 5000 MHz to 6000 MHz. Therefore, the antenna structure 100 can support at least the wideband operations of the sub-6 GHz frequency intervals of next-generation 5G communication.

With respect to the antenna theory, the first radiation element 110 is excited to generate the first frequency band FB1. The second radiation element 120 is excited to generate the second frequency band FB2. The third radiation element 130 is excited to generate the third frequency band FB3. The fourth radiation element 140 is excited to generate the fourth frequency band FB4. The fifth radiation element 150 is excited to generate the fifth frequency band FB5. The sixth radiation element 160 is excited to generate the sixth frequency band FB6. According to practical measurements, the variable-width portion 115 of the first radiation element 110 can help to fine-tune the impedance matching of the first frequency band FB1 and the second frequency band FB2, so as to effectively increase their operational bandwidths. Similarly, the variable-width design of the third radiation element 130 can also increase the operational bandwidth of the third frequency band FB3.

Figure 6:
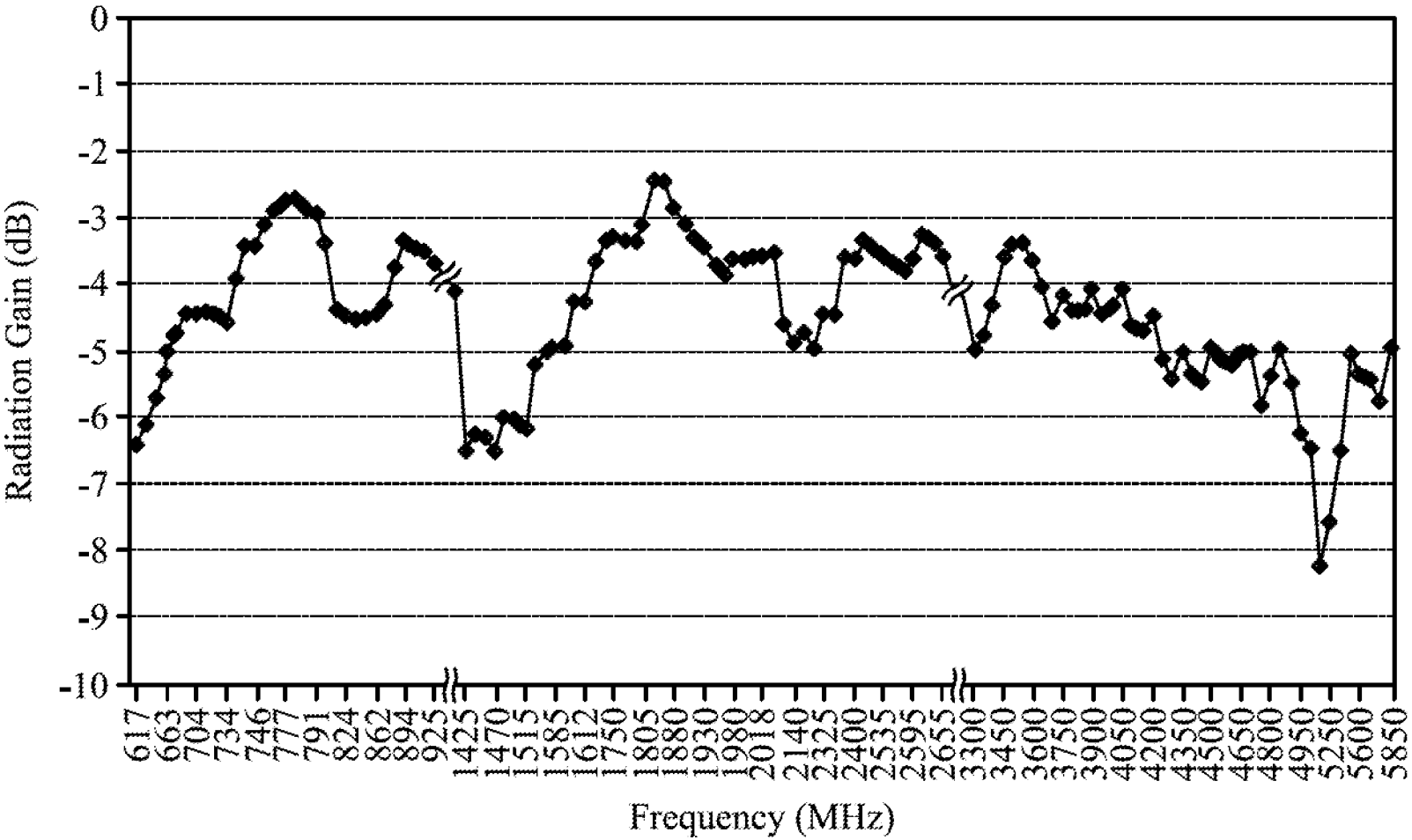
FIG. 6 is a diagram of radiation efficiency of an antenna structure according to an embodiment of the invention.

FIG. 6 is a diagram of radiation efficiency of the antenna structure 100 according to an embodiment of the invention. The horizontal axis represents the operational frequency (MHz), and the vertical axis represents the radiation efficiency (dB). According to the measurement of FIG. 6, the radiation efficiency of the antenna structure 100 can reach −6 dB or higher within the first frequency band FB1, the second frequency band FB2, the third frequency band FB3, the fourth frequency band FB4, the fifth frequency band FB5, and the sixth frequency band FB6 as described above. It can meet the requirements of practical application of next-generation 5G communication.

In some embodiments, the element sizes of the antenna structure 100 are described as follows. The length L1 of the first radiation element 110 may be substantially equal to 0.25 wavelength (λ/4) of the first frequency band FB1 of the antenna structure 100. In the first radiation element 110, the top-side width WT of the variable-width portion 115 may be from 5 mm to 10 mm, the bottom-side width WB of the variable-width portion 115 may be from 2 mm to 5 mm, and the height H1 of the variable-width portion 115 may be from 8 mm to 10 mm. The length L2 of the second radiation element 120 may be substantially equal to 0.25 wavelength (λ/4) of the second frequency band FB2 of the antenna structure 100. The width W2 of the second radiation element 120 may be from 1 mm to 2 mm. The length L3 of the third radiation element 130 may be from 0.125 to 0.25 wavelength (λ/8~λ/4) of the third frequency band FB3 of the antenna structure 100. In the third radiation element 130, the width W32 of the wide portion 136 may be 2 to 5 times the width W31 of the narrow portion 135. The length L4 of the fourth radiation element 140 may be shorter than or equal to 0.125 wavelength (λ/8) of the fourth frequency band FB4 of the antenna structure 100. The width W4 of the fourth radiation element 140 may be from 2 mm to 6 mm. The length L5 of the fifth radiation element 150 may be substantially equal to 0.25 wavelength (λ/4) of the fifth frequency band FB5 of the antenna structure 100. The length L6 of the sixth radiation element 160 may be substantially equal to 0.25 wavelength (λ/4) of the sixth frequency band FB6 of the antenna structure 100. The width W6 of the sixth radiation element 160 may be from 3 mm to 5 mm. The thickness H2 of the dielectric substrate 170 may be from 0.02 mm to 1.6 mm. The width of the first coupling gap GC1 may be shorter than or equal to 2 mm. The width of the second coupling gap GC2 may be from 1 mm to 2 mm. The above ranges of element sizes are calculated and obtained from many experimental results, and they help to optimize the operational bandwidth and impedance matching of the antenna structure 100.

Figure 7:
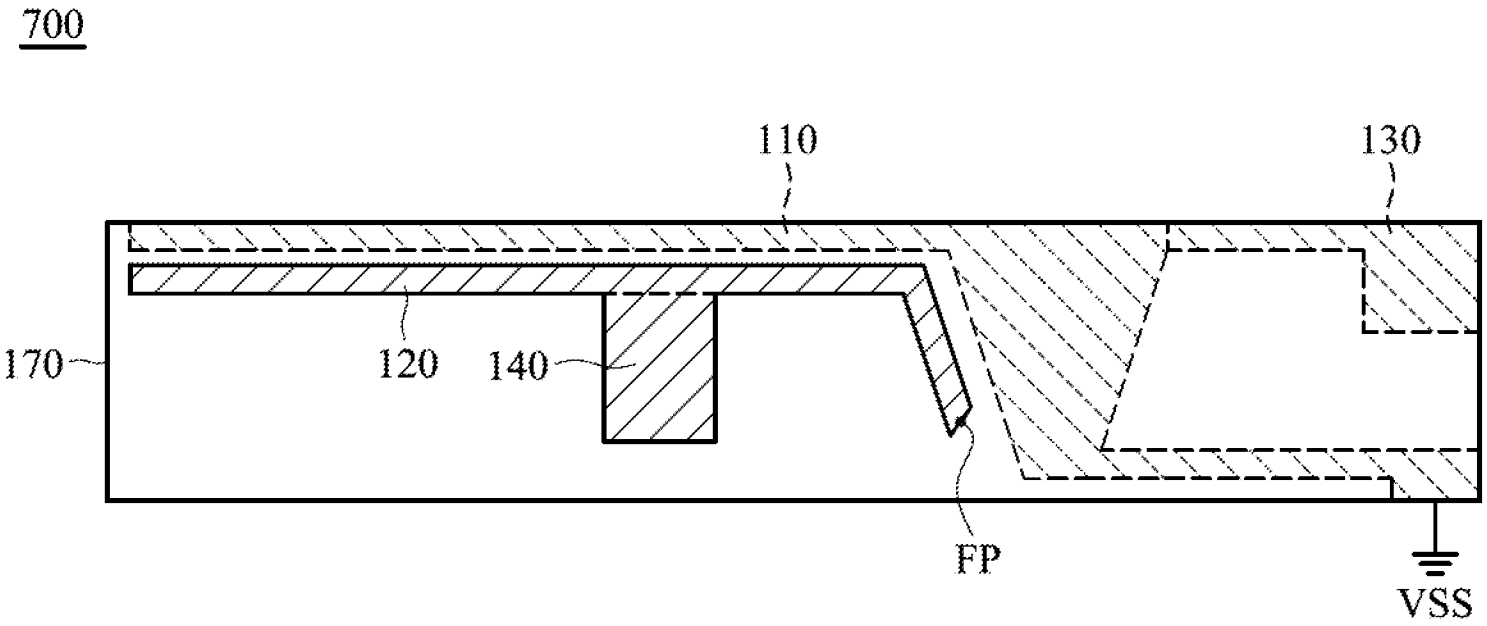
FIG. 7 is a top view of an antenna structure according to another embodiment of the invention.

FIG. 7 is a top view of an antenna structure 700 according to another embodiment of the invention. FIG. 7 is similar to FIG. 1. In the embodiment of FIG. 7, the antenna structure 700 does not include the fifth radiation element 150 and the sixth radiation element 160. According to practical measurements, even if the fifth radiation element 150 and the sixth radiation element 160 are removed, the antenna structure 700 can still cover the first frequency band FB1, the second frequency band FB2, the third frequency band FB3, and the fourth frequency band FB4 as described above. It can meet the operational requirements of low and median frequency bands of next-generation 5G communication. Other features of the antenna structure 700 of FIG. 7 are similar to those of the antenna structure 100 of FIGS. 1-4. Accordingly, the two embodiments can achieve similar levels of performance.

The invention proposes a novel antenna structure. In comparison to the conventional design, the invention has at least the advantages of small size, wide bandwidth, and low manufacturing cost, and therefore it is suitable for application in a variety of mobile communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-7. The invention may merely include any one or more features of any one or more embodiments of FIGS. 1-7. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a first radiation element, coupled to a ground voltage, wherein the first radiation element comprises a variable-width portion;

a second radiation element, having a feeding point, wherein the second radiation element is adjacent to the first radiation element;

a third radiation element, coupled to the variable-width portion of the first radiation element;

a fourth radiation element, coupled to the second radiation element;

a dielectric substrate, having a first surface and a second surface opposite to each other;

wherein the second radiation element and the fourth radiation element are disposed on the first surface of the dielectric substrate, and the first radiation element and the third radiation element are disposed on the second surface of the dielectric substrate;

wherein the antenna structure further comprises:

a fifth radiation element, coupled to the feeding point, and disposed on the first surface of the dielectric substrate, wherein the fifth radiation element substantially has an L-shape;

wherein the fifth radiation element has a vertical projection on the second surface of the dielectric substrate, and the vertical projection at least partially overlaps the variable-width portion of the first radiation element.

2. The antenna structure as claimed in claim 1, wherein the variable-width portion of the first radiation element substantially has a trapezoidal shape.

3. The antenna structure as claimed in claim 1, wherein the second radiation element substantially has a meandering shape.

4. The antenna structure as claimed in claim 1, wherein the third radiation element substantially has an L-shape.

5. The antenna structure as claimed in claim 1, wherein the fourth radiation element substantially has a straight-line shape.

6. The antenna structure as claimed in claim 1, further comprising:

a sixth radiation element, coupled to the ground voltage, and disposed on the first surface of the dielectric substrate, wherein the sixth radiation element substantially has a straight-line shape.

7. The antenna structure as claimed in claim 6, wherein the antenna structure covers a first frequency band, a second frequency band, a third frequency band, a fourth frequency band, a fifth frequency band, and a sixth frequency band, the first frequency band is from 600 MHz to 700 MHz, the second frequency band is from 700 MHz to 960 MHz, the third frequency band is from 1710 MHz to 2170 MHz, the fourth frequency band is from 2300 MHz to 2700 MHz, the fifth frequency band is from 3300 MHz to 4800 MHz, and the sixth frequency band is from 5000 MHz to 6000 MHz.

8. The antenna structure as claimed in claim 7, wherein a length of the first radiation element is substantially equal to 0.25 wavelength of the first frequency band.

9. The antenna structure as claimed in claim 7, wherein a length of the second radiation element is substantially equal to 0.25 wavelength of the second frequency band.

10. The antenna structure as claimed in claim 7, wherein a length of the third radiation element is from 0.125 to 0.25 wavelength of the third frequency band.

11. The antenna structure as claimed in claim 7, wherein a length of the fourth radiation element is shorter than or equal to 0.125 wavelength of the fourth frequency band.

12. The antenna structure as claimed in claim 7, wherein a length of the fifth radiation element is substantially equal to 0.25 wavelength of the fifth frequency band.

13. The antenna structure as claimed in claim 7, wherein a length of the sixth radiation element is substantially equal to 0.25 wavelength of the sixth frequency band.

* * * * *